US006897755B2

(12) United States Patent
Wada et al.

(10) Patent No.: US 6,897,755 B2
(45) Date of Patent: May 24, 2005

(54) IGNITION COIL FOR INTERNAL COMBUSTION ENGINE

(75) Inventors: Jyunichi Wada, Aichi (JP); Koji Tsunenaga, Chiryu (JP); Kazutoyo Osuka, Gamagori (JP)

(73) Assignee: Denso Corporation (JP)

( * ) Notice: Subject to any disclaimer, the term of this patent is extended or adjusted under 35 U.S.C. 154(b) by 0 days.

(21) Appl. No.: 10/720,170

(22) Filed: Nov. 25, 2003

(65) Prior Publication Data

US 2004/0104796 A1 Jun. 3, 2004

Related U.S. Application Data

(62) Division of application No. 10/139,639, filed on May 7, 2002.

(30) Foreign Application Priority Data

May 8, 2001 (JP) ..... 2001-137824
Oct. 18, 2001 (JP) ..... 2001-321131
Feb. 5, 2002 (JP) ..... 2002-28064
Apr. 8, 2002 (JP) ..... 2002-105111

(51) Int. Cl.[7] ..... H01F 27/02
(52) U.S. Cl. ..... 336/90; 336/92; 336/96
(58) Field of Search ..... 336/90, 92, 96; 123/634, 635

(56) References Cited

U.S. PATENT DOCUMENTS 4,639,706 A 1/1987 Shimizu
5,963,118 A * 10/1999 Kawano et al. ..... 336/198
6,060,973 A * 5/2000 Kawano et al. ..... 336/190
6,208,231 B1 3/2001 Oosuka et al.
6,386,189 B2 * 5/2002 Shimada et al. ..... 123/634
6,571,784 B2 6/2003 Shiimada et al.

FOREIGN PATENT DOCUMENTS

JP 11-111545 4/1999

* cited by examiner

*Primary Examiner*—Anh Mai
(74) *Attorney, Agent, or Firm*—Nixon & Vanderhye PC

(57) ABSTRACT

In a stick coil, there is disclosed an ignition coil for an internal combustion engine which can prevent a crack (a collar leak) from being generated due to a thermal stress. In this ignition coil, the structure is made such that a size (L) of a portion which is in parallel to an axial direction of a primary spool (121) in a projection portion (121*b*) is larger than a size (T) of a portion which is in parallel to an orthogonal direction to the axial direction of the primary spool (121). Accordingly, a frontal projected area of the projection portion (121*b*) as seen from a flowing direction of a resin becomes small, a resin flow is hard to get out of order at a time when the resin flows through a portion corresponding to the projection portion (121*b*) at the forming time, and a convoluted void and a weld are hard to be generated. Accordingly, since it is possible to prevent a mechanical strength in a root portion of the projection portion (121*b*) from being reduced, it is possible to previously prevent a crack from being generated in the root portion of the projection portion (the collar portion) (121*b*) due to a thermal stress so as to reduce an insulating property.

4 Claims, 12 Drawing Sheets

IGNITION COIL FOR INTERNAL COMBUSTION ENGINE

RELATED APPLICATION

This application is a divisional of commonly assigned application Ser. No. 10/139,639 filed May 7, 2002.

BACKGROUND OF THE INVENTION

1. Field of the Invention

The present invention relates to an ignition coil for an internal combustion engine (hereinafter, referred to as an ignition coil for short).

2. Description of the Prior Art

A structure of an ignition coil for a motor vehicle is, for example, as described in Japanese Unexamined Patent Publication No. 11-111545, constituted by a primary coil wound around a primary spool, a secondary coil wound around a secondary spool which are concentrically arranged in an outer peripheral side of a rod-like center core, a resin member (a potting member or a cast resin) charged into a gap between these plurality of parts, and the like.

However, since coefficients of linear expansion of the respective constituting parts are different from each other, a crack or the like may be generated between the constituting parts (particularly, in a root side of a collar portion in a spool around which a coil winding is arranged) due to a thermal stress. Further, each of the spools is frequently integrally formed by a resin, however, a flow of mold resin is deteriorated in some shapes thereof, so that a void or the like may be generated. Then, since the generation of the crack, the void or the like causes a dielectric breakdown by each of the spools, it is necessary to restrict and prevent them.

SUMMARY OF THE INVENTION

The present invention has been achieved by taking the conventional problems mentioned above, and an object of the present invention is to provide an ignition coil for an internal combustion engine which can prevent a crack, a void or the like from being generated, and can secure an insulating property between a primary side and a secondary side.

In order to achieve the object mentioned above, in accordance with the present invention, there is provided an ignition coil for an internal combustion engine comprising:

a resin spool 121 formed in a substantially cylindrical shape;

a coil 120 constituted by a coil winding wound around the spool 121; and a high electric voltage being supplied to an ignition apparatus in the internal combustion engine, wherein a plurality of projection portions 121*b* protruding to an outer side in a diametrical direction from an outer peripheral surface of the spool 121 are integrally formed in an end portion in an axial direction on the outer peripheral surface of the spool 121 so as to line up in a circumferential direction, and a size L of a portion in the projection portion 121*b* which is in parallel to an axial direction of the spool 121 is larger than a size T of a portion in the projection portion 121*b* which is in parallel to a direction orthogonal to the axial direction of the spool 121.

Accordingly, in comparison with the spool in accordance with a prior art mentioned below, a resin flow is hard to get out of order near a portion corresponding to the projection portion 121*b* at a time of forming, and a convoluted void and weld are hard to be generated.

Therefore, in accordance with the present invention, since it is possible to prevent a mechanical strength in a root portion of the projection portion 121*b* from being reduced, it is possible to previously prevent the crack from being generated in the root side of the projection portion 121*b*.

In accordance with the present invention, there is provided an ignition coil for an internal combustion engine comprising:

a resin spool 121 formed in a substantially cylindrical shape;

a coil 120 constituted by a coil winding wound around the spool 121; and a high electric voltage being supplied to an ignition apparatus in the internal combustion engine, wherein a projection portion 121*b* protruding to an outer side in a diametrical direction from an outer peripheral surface of the spool 121 and assembled in the spool 121 after being separately formed from the spool 121 is provided in an end portion in an axial direction on the outer peripheral surface of the spool 121.

Accordingly, since it is possible to make a shape of the spool 121 simple, a resin flow is hard to get out of order at a time of forming the spool 121. Therefore, it is possible to prevent the crack from being generated in the spool 121.

In accordance with the present invention, there is provided an ignition coil for an internal combustion engine comprising:

a resin spool 121 formed in a substantially cylindrical shape;

a coil 120 constituted by a coil winding wound around the spool 121;

a high electric voltage being supplied to an ignition apparatus in the internal combustion engine; and a resin material having an electric insulating property being charged into a substantially cylindrical housing 172 receiving the coil 120 and the spool 121, whereby the coil 120 and the spool 121 are molded and fixed, wherein at least a portion corresponding to the coil 120 in the spool 121 has an inner tube portion 121α and an outer tube portion 121β so as to form a double cylinder structure, a projection portion 121*b* protruding to an outer side in a diametrical direction is formed in an end portion in an axial direction of the outer tube portion 121β, and an adhesive strength between the resin material and the outer tube portion 121β is smaller than an adhesive strength between the resin material and the inner tube portion 121α.

Accordingly, since all of the coil windings in the coil 120 become in a state of being wound on the outer tube portion 121β, a starting point of the crack is hard to be generated in the portion in which the coil winding of the coil 120 is wound. Therefore, it is possible to prevent the crack from being generated and made progress in the portion close to the coil 120.

In accordance with the present invention, there is provided an ignition coil for an internal combustion engine comprising:

a resin spool 121 formed in a substantially cylindrical shape;

a coil 120 constituted by a coil winding wound around the spool 121;

a high electric voltage being supplied to an ignition apparatus in the internal combustion engine; and a resin material having an electric insulating property being charged into a substantially cylindrical housing 172 receiving the coil 120 and the spool 121, whereby the coil 120 and the spool 121 are molded and fixed, wherein an adhesion restraining film 122 which restrains an adhesion between an outer peripheral surface of the spool 121 and the coil winding by the resin material is provided between the outer peripheral surface of the spool 121 and the coil winding, and a distance r2 from the adhesion restraining film 122 in an end portion side in an axial direction of the spool 121 to a center axis of the spool 121 is larger than a distance r1 from the adhesion restraining film 122 in a substantially center portion in the axial direction of the spool 121 to the center axis of the spool 121.

Accordingly, since a way (time) until the crack gets to a center portion becomes long, it is possible to prevent the spool 121 from being early broken.

In accordance with the present invention, there is provided an ignition coil for an internal combustion engine comprising:

a primary coil 120 and a secondary coil 120 which are coaxially arranged;

a center core inserted to axial core portions in both of the coils 120 and 130;

an outer peripheral core 140 arranged in an outer peripheral side of both of the coils 120 and 130;

a substantially cylindrical housing 172 receiving both of the coils 120 and 130 and both of the cores 110 and 140; and a resin material having an electric insulating property being charged into the housing 172, whereby both of the coils 120 and 130 and both of the cores 110 and 140 are molded and fixed, wherein a slit 141 dividing a part of the outer peripheral coil 140 and extending in a longitudinal direction is provided in the outer peripheral core 140.

Accordingly, since a rigidity of the outer peripheral core 140 is reduced and the outer peripheral core 140 is deformed at a time when a thermal stress is applied, whereby it is possible to absorb the thermal stress, it is possible to prevent the crack from being generated in the spool 121.

In accordance with the present invention, there is provided an ignition coil for an internal combustion engine comprising:

an integrally formed resin spool 121 and a coil 120 constituted by a coil winding wound around the spool 121; and a high electric voltage being supplied to an ignition apparatus in the internal combustion engine, wherein the spool 121 is provided with a cylinder portion 121*d* around which the coil 120 is wound, a collar portion 121*b* protruding to an outer side in a diametrical direction from an end side outer peripheral surface of the outer portion 121*d* so as to form a circumferential shape, and a reinforcing portion 121*c* connected to the collar portion 121*b*, extending in an axial direction of the cylinder portion 121*d* and reinforcing the collar portion 121*b*, and wherein a ratio of thickness t/t0 of a thickness t of the collar portion 121*b* and/or the reinforcing portion 121*c* with respect to a thickness t0 of the cylinder portion 121*d* is equal to or less than 1.5.

Further, the inventors of the present application have invented a spool shape in which the void or the like is not generated by setting the ratio of thickness t/t0 mentioned above to a predetermined range, even in the case that the collar portion 121*b* protruding from an end side of the cylinder portion is provided. Further, in this case, since the collar portion 121*b* and the reinforcing portion 121*c* are integrally formed, the structure is excellent in view of strength, and it is possible to restrain and prevent generation of the crack or the like.

It is more preferable that this ratio of thickness t/t0 is equal to or less than 1.2, and further equal to or less than 1. In particular, the smaller the thickness of the collar portion and/or the reinforcing portion is, the harder the void or the like is generated.

As a matter of fact, it is preferable that the ratio of thickness t/t0 mentioned above is equal to or more than 0.1, taking a strength, a formability and the like into consideration.

Further, various kinds of shapes can be considered for a shape between the collar portion 121*b* and the reinforcing portion 121*c*, however, it is possible to structure, for example, in a manner described in claim 8 or 9.

That is, the reinforcing portion 121*c* may be extended from a substantially center of the collar portion 121*b* and form a substantially T shape with the collar portion 121*b*, or may be extended from both end sides of the collar portion 121*b* and form a substantially U shape with the collar portion 121*b*.

In accordance with the present invention, there is provided an ignition coil for an internal combustion engine comprising:

a coil 120 around which a coil winding is wound;

a resin spool 121 having a cylinder portion 121*d* around which the coil winding of the coil 120 is wound, and a collar portion 121*b* protruding to an outer side in a diametrical direction from an outer peripheral surface of the cylinder portion 121*d* so as to form a circumferential shape and being capable of holding an end portion of the coil 120; and a high electric voltage being supplied to an ignition apparatus in the internal combustion engine, wherein an elastic member 123 is provided at least in the coil winding side of the coil 120 connected to the collar portion 121*b* from the cylinder portion 121*d*.

A thermal stress or the like can be applied to the cylinder portion 121*d* and the collar portion 121*b* which the coil 120 is in contact with and exists in, due to a difference of coefficients of linear expansion among the respective members. In particular, the thermal stress or the like is easily concentrated to the root portion of the collar portion 121*b* corresponding to the connecting portion thereof. In accordance with the present invention, since the elastic member 123 reducing the thermal stress or the like is provided therebetween, it is possible to restrain and prevent the generation of the crack or the like in the spool 121 accompanying with the thermal stress or the like.

The elastic member 123 may be, for example, constituted by an elastic film coated on the spool 121. The elastic film can be formed by spraying or painting an elastic resin (for example, an urethane resin), a rubber or the like to the spool 121, or dipping the spool 121 into them.

Further, the elastic member 123 may be constituted by an elastic film which is integrally formed with the spool 121.

In this case, for example, it is possible to integrally form both of the spool 121 and the elastic resin, the rubber or the like by setting the spool 121 to a core and charging the elastic resin, the rubber or the like into a cavity generated in an outer periphery thereof. Further, the elastic film may be formed by winding an elastic film having a heat shrinkability around the spool 121 and thereafter heating this, thereby closely attaching the elastic film to the outer surface of the spool 121.

In accordance with the present invention, there is provided an ignition coil for an internal combustion engine comprising:

a coil 120 in which a coil winding is wound around a substantially cylindrical spool 121; and a high electric voltage being supplied to an ignition apparatus in the internal combustion engine, wherein the spool 121 has a cylinder portion 121*d*, and a collar portion 121*b* capable of holding an end portion of the coil 120 formed so as to protrude in an outer side in a diametrical direction from an outer peripheral surface of the cylinder portion 121*d* so as to form a circumferential shape by winding an elastic sheet 123 having linearly arranged projections 123*a* around the cylinder portion 121*d*.

In this case, the collar portion 121*b* capable of holding the end portion of the coil 120 is not integrally provided with the spool 121, but is formed by winding the elastic sheet 123. Since the elastic sheet 123 is interposed between the coil 120 and the spool 121, the thermal stress or the like applied to a portion between the cylinder portion 121*d* and the collar portion 121*b* is reduced, and the crack or the like generated in the root portion or the like of the collar portion 121*b* can be restrained and prevented.

Further, in the case of integrally forming the spool 121 by the resin, since it is not necessary to integrally form the collar portion 121*b* by the resin, a resin flow at a time of forming is improved, and it is possible to restrain the generation of void or the like. Further, since the collar portion 121*b* is formed by winding the elastic sheet 123 corresponding to a separate member from the spool 121, a freedom of design can be increased without being affected by a limitation caused by the generation of the void or the like.

In accordance with the present invention, there is provided an ignition coil for an internal combustion engine comprising:

a coil 120 in which a coil winding is wound around a substantially cylindrical spool 121; and a high electric voltage being supplied to an ignition apparatus in the internal combustion engine, wherein the spool 121 is constructed by inserting and fitting an outer tube portion 121β constituted by an elastic member to an inner tube portion 121α, the outer tube portion 121βhas a cylinder portion 121*d* around which a coil winding of the coil 120 is wound, and a collar portion 121*b* protruding to an outer side in a diametrical direction from an outer peripheral-surface of the cylinder portion 121*d* so as to form a circumferential shape and capable of holding an end portion of the coil 120.

Since the spool 121 is constructed by a double structure constituted by the inner tube portion 121α and the outer tube portion 121β, it is possible to easily form the spool 121 having no void or the like. Further, since the outer tube portion 121β is constituted by the elastic member, the thermal stress or the like is reduced from the cylinder portion 121*d* toward the collar portion 121*b*, and it is possible to restrain and prevent the generation of the crack or the like on the basis thereof.

In accordance with the present invention, there is provided an ignition coil for an internal combustion engine comprising:

a spool formed in a substantially cylindrical shape and having a projection portion 121*b* arranged in one end portion in an axial direction of an outer peripheral surface;

a coil 120 annularly provided in the spool 121 and having one end constituted by a coil winding held by the projection portion 121*b;* an adhesion restraining film 122 interposed between the spool 121 and the coil winding and restraining an adhesion between the outer peripheral surface of the spool 121 and the coil winding; and a high electric voltage being supplied to an ignition apparatus in the internal combustion engine, wherein the ignition coil further has a post-provided collar portion 121*f* which is annularly provided in the adhesion restraining film 122 at another end portion in an axial direction of the outer peripheral surface of the spool 121 and holding another end of the coil 120.

In conventional, the projection portion 121*b* and the flange portion 121*e* are integrally formed at both end portions in the axial direction of the spool 121. Further, the adhesion restraining film 122 is annularly provided in the outer peripheral surface of the spool 121 between the projection portion 121*b* and the flange portion 121*e*. Further, the thermal stress applied to the diametrical direction of the ignition coil is shut off by the adhesion restraining film 122.

However, the adhesion restraining film 122 can be annularly provided only between the projection portion 121*b* and the flange portion 121*e*. In other words, since the flange portion 121*e* gets in the way, it is impossible to extend the adhesion restraining film 122 close to the end side in the axial direction over the flange portion 121*e* of the spool 121.

In this view, in accordance with the present invention, the post-provided collar portion 121*f* is arranged in place of the flange portion 121*e*. The post-provided collar portion 121*f* is annularly provided in the outer peripheral surface of the adhesion restraining film 122 after annularly attaching the adhesion restraining film 122 to the spool 121. Therefore, in accordance with the invention described in claim 15, it is possible to extend the adhesion restraining film 122 close to the end side in the axial direction over the post-provided collar portion 121*f*. Accordingly, a range in which the thermal stress can be shut off becomes wide, and it is possible to restrain and prevent the generation of the crack or the like.

In accordance with the present invention, there is provided an ignition coil for an internal combustion engine comprising:

a spool 121 formed in a substantially cylindrical shape and having a projection portion 121*b* arranged in one end portion in an axial direction of an outer peripheral surface;

a coil 120 annularly provided in the spool 121 and having one end constituted by a coil winding held by the projection portion 121*b;* an adhesion restraining film 122 interposed between the spool 121 and the coil winding and restraining an adhesion between the outer peripheral surface of the spool 121 and the coil winding; and a high electric voltage being supplied to an ignition apparatus in the internal combustion engine, wherein the coil winding is a self welding coil winding, and the coil 120 is a shape keeping coil 120*a* capable of keeping a shape by itself.

The shape keeping coil 120*a* is formed by the self welding coil winding. Accordingly, it is possible to keep the cylindrical shape by itself without holding both ends by the projection portion 121*b* and the flange portion 121*e*. Therefore, the flange portion 121*e* is not required.

In accordance with the present invention, since the flange portion 121*e* is not arranged, it is possible to extend the adhesion restraining film 122 to the end side in the axial direction. Accordingly, the range in which the thermal stress can be shut off becomes wide, and it is possible to restrain and prevent the generation of the crack or the like.

Here, in the case that the elastic film is provided in the collar portion 121*b* or the collar portion 121*b* itself is constituted by the elastic member as in the present invention, the shape of the collar portion 121*b* provides no problem. Accordingly, the collar portion 121*b* may be formed in a continuous ring shape, or may be formed in a discontinuous projection shape. As a matter of fact, taking into consideration a flow property of an epoxy resin or the like corresponding to a filler in the inner portion of the housing or the inner portion of the coil, it is preferable that the collar portion 121*b* is formed in the discontinuous projection shape.

Further, the various kinds of elastic members may employ a structure having a rigidity (Young's modulus) lower than that of the core member (the inner tube portion) of the spool 121. In the case that the spool 121 is made of a thermosetting resin, for example, a rubber, an urethane resin or the like can be used as the elastic member. Further, the elastic member does not necessarily exist in a whole of the spool, but may partly exist in a range which is effective for reducing the stress such as the thermal stress or the like.

In this case, the spool mentioned above may be constituted by a primary spool and a secondary spool. Further, the projection portion 121*b* and the collar portion 121*b* correspond only to convenient appellations, and both of them become substantially the same properly. Further, reference numerals in parentheses indicated in claims and means for solving the problem mentioned above are used only for clarifying a corresponding relation to particular examples described in embodiments mentioned below so as to easily understand the present invention, and do not limit the scope of the present invention to the embodiments mentioned below.

BRIEF DESCRIPTION OF THE DRAWINGS

FIGS. 12A and 12B are views showing a feature of an ignition coil in accordance with a tenth embodiment of the present invention, in which FIG. 12A is a partly cross sectional view of the ignition coil and FIG. 12B is a plan view of an elastic sheet used in the present embodiment;

DETAILED DESCRIPTION OF EMBODIMENTS OF THE INVENTION (First Embodiment)

Figure 1:
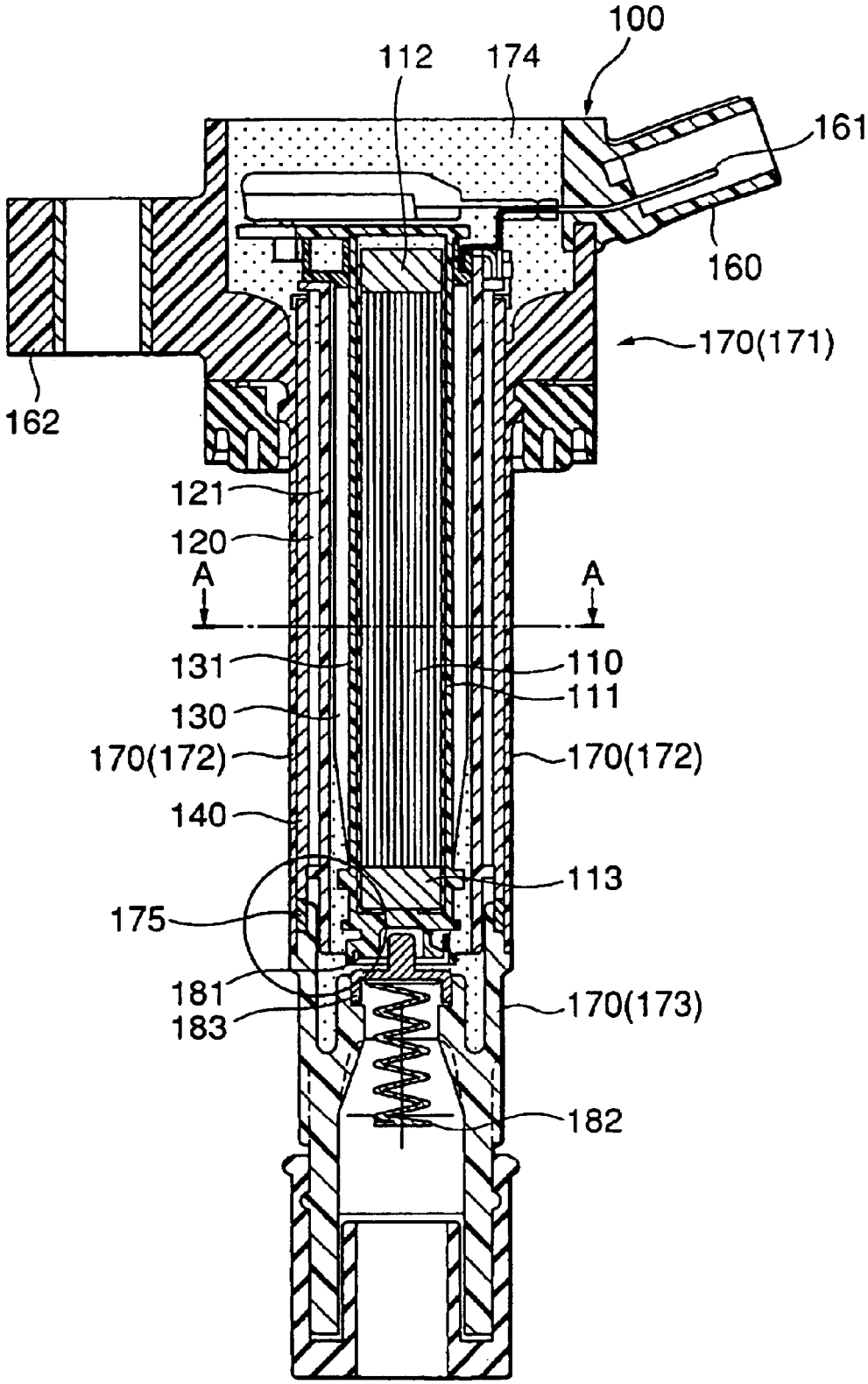
FIG. 1 is a cross sectional view of an ignition coil in accordance with an embodiment of the present invention.
Figure 2:
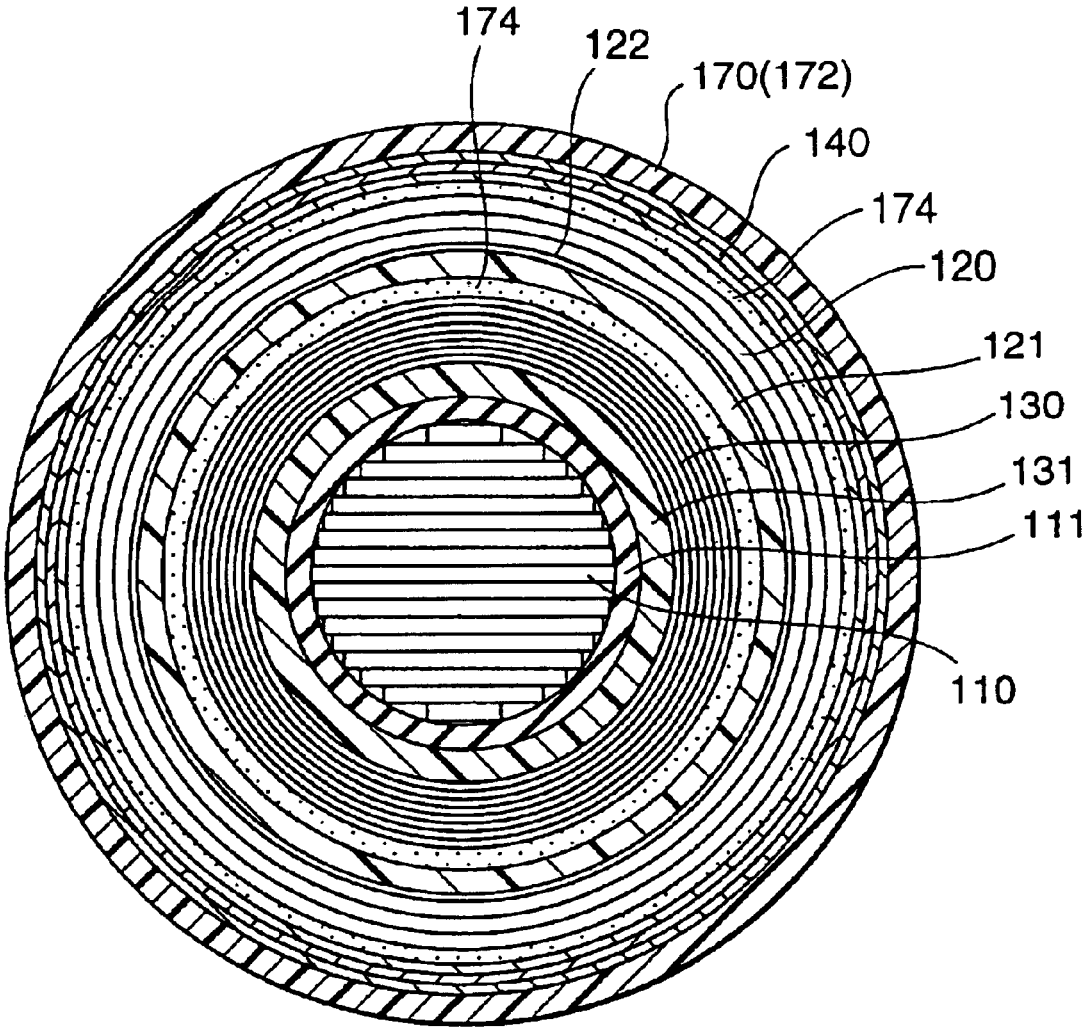
FIG. 2 is a cross sectional view along a line A—A in FIG. 1.

The present embodiment corresponds to a structure obtained by applying an ignition coil in accordance with the present invention to an ignition coil for a vehicle which supplies a high electric voltage (for example, 30 kV) to a spark plug (an ignition apparatus) in an engine (an internal combustion engine) for driving the vehicle. FIG. 1 is a cross sectional view in an axial direction (a cross sectional view of a whole) of an ignition coil 100 in accordance with the present embodiment, and FIG. 2 is a cross sectional view along a line A—A in FIG. 1.

In this case, the ignition coil 100 in accordance with the present embodiment is integrally formed with a plug cap by being formed in a stick shape in an outer shape, and this ignition coil 100 is received within a plug hole formed in a cylinder head (not shown) at a time of being attached. In this case, the plug cap means a cap-like connector electrically connecting the spark plug to the ignition coil.

In FIG. 1, reference numeral 110 denotes a rod-like center core made of a magnetic material (a silicon steel in the present embodiment). The center core 110 is a lamination core constructed by laminating a plurality of thin band plates extending substantially in parallel to a direction of a magnetic field (a direction perpendicular to a paper surface), as shown in FIG. 2. In this case, permanent magnets 112 and 113 (refer to FIG. 1) having a reverse polarity to that of a magnetic field induced by a primary coil 120 mentioned below are arranged in both end sides in a longitudinal direction of the center core 110.

Further, a secondary coil (an inner periphery side coil) 130 electrically connected to a side of the spark plug is arranged in an outer periphery side of the center core 110, and the primary coil (an outer periphery side coil) 120 to which a control signal from an igniter controlling a high electric voltage generated in the secondary coil 130 is input is arranged in an outer side of the secondary coil 130.

In this case, since the ignition coil 100 is structured such that the electric voltage input to the primary coil 120 is increased so as to be output from the secondary coil 130, a winding number of the secondary coil 130 is more than a winding number of the primary coil 120, and since the secondary coil 130 is arranged in an inner side of the primary coil 120, a wire diameter of the coil winding in the secondary coil 130 is set to be smaller than a wire diameter of the coil winding in the primary coil 120.

Further, reference numeral 121 denotes a primary spool (an outer periphery side winding frame) for winding the coil winding in the primary coil 120 arranged between the secondary coil 130 and the primary coil 120, and this primary spool 121 is formed in a substantially cylindrical shape by an electrical insulating material such as a resin (a PPE resin in the present embodiment) or the like.

Figure 3A:
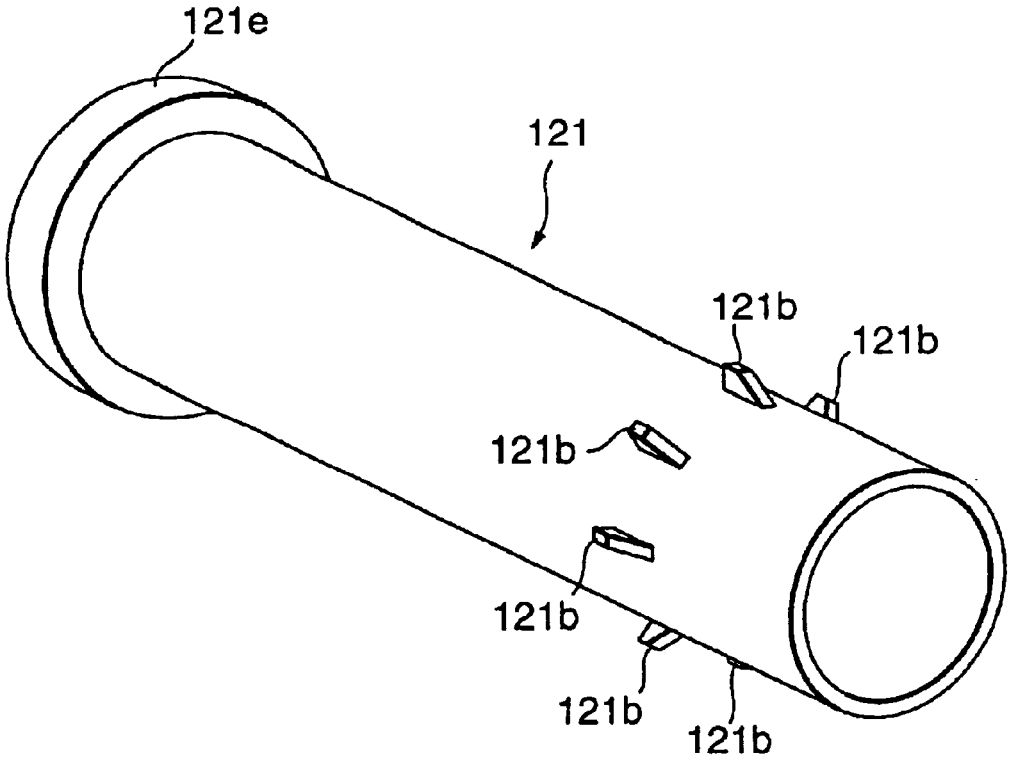
FIG. 3A is a perspective view of a primary spool employed in an ignition coil in accordance with a first embodiment of the present invention.

Further, a thin film (an adhesion restraining film) 122 made of a polyethylene terephthalate (PET) is wound around the outer peripheral surface of the primary spool 121 (between the primary coil 120 and the primary spool 121) so as to prevent the primary spool 121 and a resin for molding (a cast resin) mentioned below from being completely adhered, and as shown in FIG. 3A, a plurality of projection portions 121*b* protruding to an outer side in a diametrical direction from an outer peripheral surface 121*a* are integrally formed in one end side in an axial direction thereof (a right end side in FIG. 3A and a side of a high voltage terminal 183 mentioned below) so as to line up in a circumferential direction.

Figure 3B:
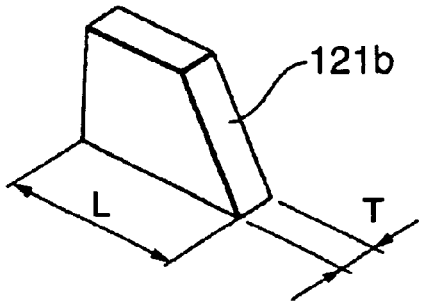
FIG. 3B is an enlarged view of a projection portion.

At this time, the projection portion 121*b* is structured in a root side thereof, as shown in FIG. 3B, such that a size L of a portion in parallel to the axial direction of the primary spool 121 in the projection portion 121*b* is larger than a size T of a portion in parallel to a direction orthogonal to the axial direction of the primary spool 121, and a portion corresponding to one end side (a right end side in FIG. 3B) in the axial direction of the primary spool 121 in the projection portion 121*b* is formed in a taper shape so that a cross sectional area of the projection portion 121*b* is reduced toward a front end side thereof.

On the contrary, a ring-like flange portion 121*e* protruding to an outer side in the diametrical direction from the outer peripheral surface 121*a* all around a circumferential direction is integrally formed in another end side (a left end side in FIG. 3A, and a side of a bracket portion 162 mentioned below) in the axial direction of the primary spool 121.

Further, in FIGS. 1 and 2, reference numeral 131 denotes a secondary spool (an inner periphery side winding frame) for winding the secondary coil 130, the secondary spool being arranged between the secondary coil 130 and the center core 110, and this secondary spool 131 is formed in a substantially cylindrical shape by the electrical insulating material such as the resin (the PPE resin in the present embodiment) or the like.

Further, a buffering member (a rubber tube in the present embodiment) 111 for preventing an edge portion (a corner portion) of the center core 110 from being directly in contact with the secondary spool 131 is arranged in an inner peripheral surface side of the secondary spool 131 (between the secondary spool 131 and the center core 110).

In this case, the buffering member (a shrink tube) 111 is structured such that a diameter is reduced by being heated, and the buffering member (the shrink tube) 111 is closely attached to the center core 110 by heating the center core 110 in a state of inserting the center core 110 to the buffering member (the shrink tube) 111.

A tubular outer peripheral core 140 made of a magnetic material (a silicon steel in the present embodiment) is arranged in an outer periphery side of the primary coil 120, and this outer peripheral core 140 is constructed by coaxially laminating three pipe members.

In this case, reference numeral 160 denotes a connector portion to which a cable (not shown) transmitting a control signal is connected, reference numeral 161 denotes a terminal supplying the control signal to the primary coil 130, and reference numeral 170 denotes a housing for the ignition coil 100, the housing being made of the resin (the PPS resin in the present embodiment).

In this case, the housing 170 is constituted by three sections comprising a first housing portion 171 in which a bracket portion 162 for fixing the connector portion 160 and the ignition coil 100 to a cam cover (not shown) is integrally formed, a second housing portion 172 covering an outer peripheral side of the outer peripheral core 140 so as to protect an ignition coil main body portion (a portion in which the primary coil 120, the secondary coil 130 and the like are received), and a third housing (a high voltage tower) 173 in which a first high voltage terminal 181 to which a leader line (not shown) provided in an end portion in an axial direction of the secondary coil is connected, a second high voltage terminal 183 electrically connecting (relaying) the first high voltage terminal to a spring 182 being in contact with a terminal of the spark plug and a conductive material, and the like are received.

Further, a cast resin (an epoxy resin in the present embodiment) having an electrical insulating property is charged within the housing 170 (particularly within the outer peripheral core 140), whereby both of the coils 120 and 130, and the other parts are mold fixed. In this case, in FIGS. 1 and 2, reference numeral 174 denotes a resin layer structured by the charged resin (the cast resin), and in FIG. 1, reference numeral 175 denotes a rubber packing which prevents the cast resin from leaking from a connection portion between the second housing 172 and the third housing 173.

Next, a description will be given of a feature (an operation and effect) of the present embodiment.

Figure 14A:
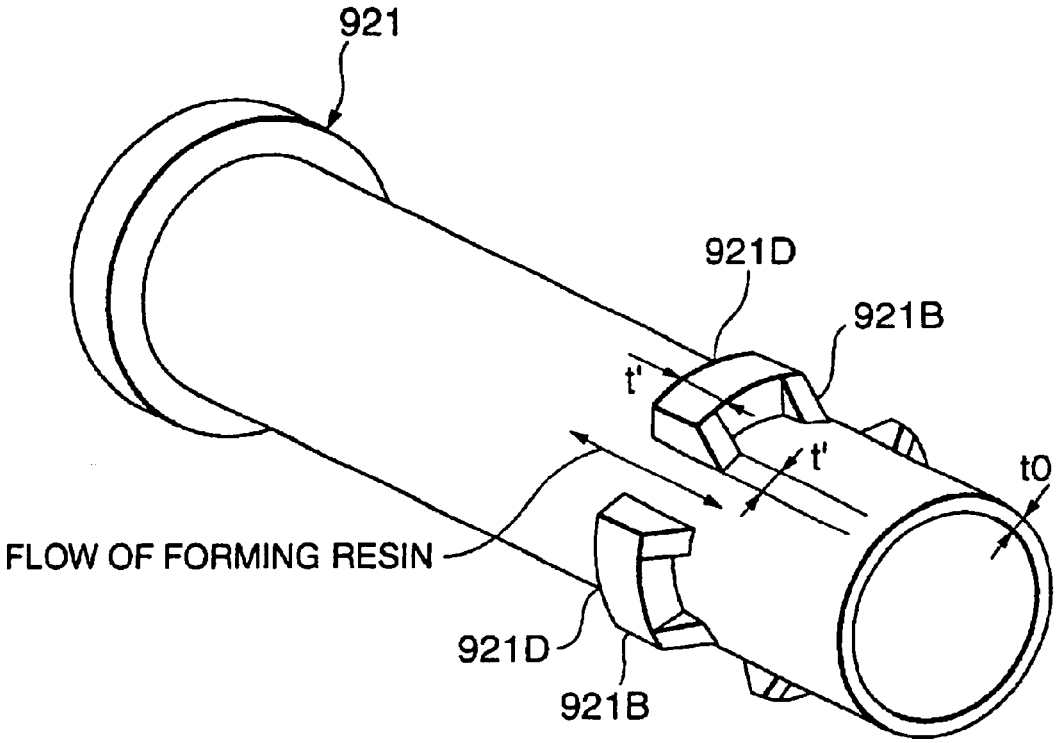
FIG.14A PRIOR ART
FIG. 14A is a perspective view of a primary spool employed in an ignition coil in accordance with a prior art.
Figure 14B:
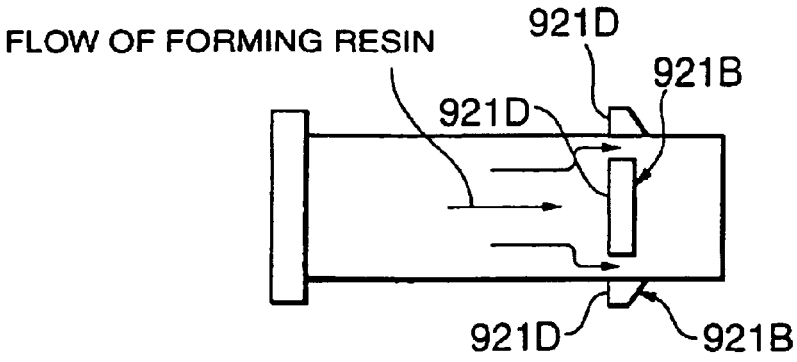
FIG.14B PRIOR ART
FIG. 14B is a front elevational view of the primary spool employed in the ignition coil in accordance with the prior art.

FIG. 14A is a perspective view of a primary spool 921 in accordance with a prior art. Projection portions 921B are provided in one end side in an axial direction thereof (a side of the high voltage terminal 183, that is, a right end side in FIG. 14A). A collar portion 921D expanding in a direction orthogonal to an axial direction of the primary spool 921 and constituted by a comparatively thick wall surface is formed in the projection portion 921B, as shown in FIGS. 14A and 14B. A thickness t' thereof is set to be about twice larger than a thickness t0 of the cylinder portion (that is, a ratio of thickness $(t'/t0)\approx 2$).

In this case, at a time of forming the primary spool 921, the resin is injected to a portion corresponding to a substantially center portion in the axial direction of the primary spool 921 in a metal mold for forming the primary spool 921 from a film gate formed in a straight line in the axial direction or a link-like ring gate provided in a portion corresponding to one end side in the axial direction of the primary spool 921.

At this time, the resin injected from both of the gates flows between the projection portions 921B so as to flow in the axial direction as shown by an arrow in FIG. 14A. However, in the primary spool 921 in accordance with the prior art, as shown in FIG. 14B, since the collar portions 921D expanding in the direction orthogonal to the axial direction of the primary spool 921 and made of the comparatively thick wall surface are formed, a resin flow gets out of order in the portion corresponding to the projection portions 921B at a time of forming, and the resin is charged together with a convoluted void (which is similar to a mold cavity and a fine bubble) and a weld (a linear resin interface), so that a mechanical strength of the resin (the primary spool 921) is reduced in this portion.

As a result, the crack or the like may be generated in a root side of the collar portion 921D and the projection portion 921B in the primary spool 921 due to a thermal stress caused by a difference of coefficients of linear expansion (amounts of thermal expansion) between the respective constituting parts, at a time of using the ignition coil 100.

On the contrary, in accordance with the present embodiment, since the size L of the portion which is in parallel to the axial direction of the primary spool 121 in the projection portion 121*b* is larger than the size T of the portion which is in parallel to the direction orthogonal to the axial direction of the primary spool 121 (L>T), a frontal projected area of the projection portion 121*b* as seen from a flowing direction of the resin becomes smaller than that of the primary spool 121 in accordance with the prior art, the resin flow is hard to get out of order at a time when the resin flows between the portions corresponding to the projection portions 121*b* at the forming time, and the convoluted void and the weld are hard to be generated.

Therefore, in accordance with the present embodiment, since it is possible to prevent the mechanical strength in the root portion of the projection portion 121*b* from being reduced, it is possible to previously prevent the crack from being generated in the root side of the projection portion 121*b* due to the thermal stress.

By extension, since it is possible to prevent the crack from being generated in the primary spool 121, it is possible to stably secure an electrical insulation between the primary coil 120 and the secondary coil 130, and it is possible to improve a durability of the ignition coil 100.

(Second Embodiment)

The present embodiment is structured, in the same manner as that of the first embodiment, such as to improve the resin flow generated at a time of forming a primary spool 121 and restrain and prevent the generation of the void or the like, whereby a mechanical strength of a collar portion 121*b* and a reinforcing portion 121*c* is not reduced.

Figure 4A:
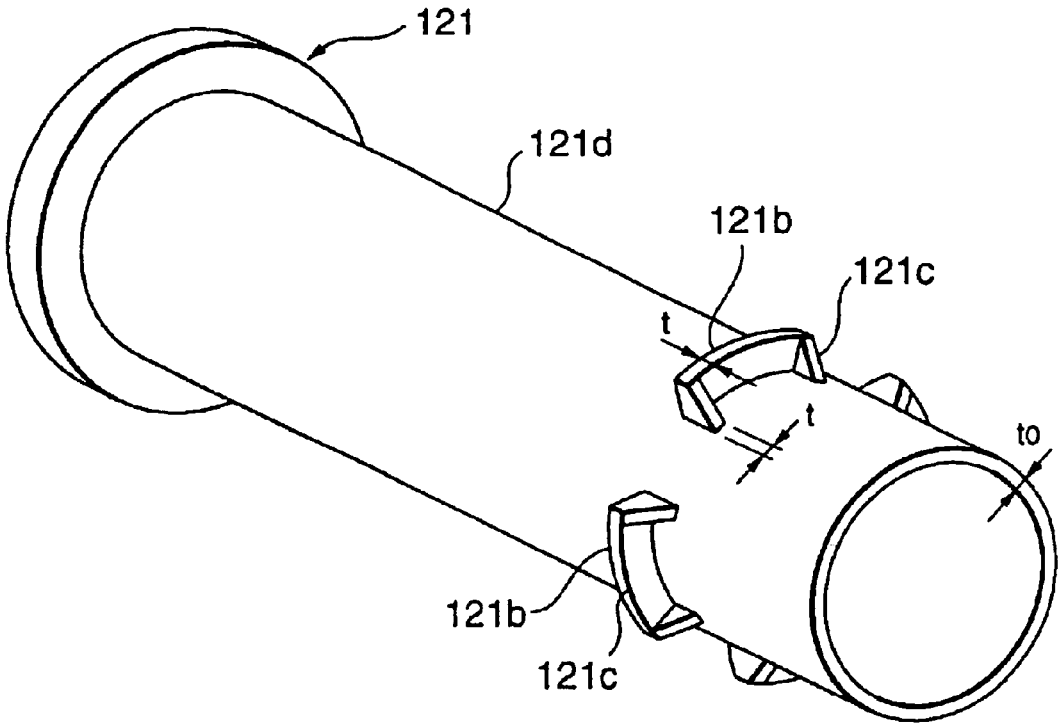
FIG. 4A is a perspective view of a primary spool employed in an ignition coil in accordance with a second embodiment of the present invention.

As shown in FIG. 4A, the end portion in the axial direction of the primary spool 121 has a plurality of projection portions formed in a substantially U shape by the discontinuous collar portions 121*b* protruding to an outer side in a radial direction from an outer peripheral surface of a cylinder portion 121*d* and the reinforcing portion 121*c* connected to the collar portion 121*b* and extending to the end portion side in the axial direction.

Here, in the present embodiment, a thickness t of the collar portion 121*b* and the reinforcing portion 121*c*, and a thickness t0 of the cylinder portion 121*d* are set to be equal. That is, a ratio of thickness (t/t0)=1 is set.

When determining a shape of the collar portion 121*b* or the reinforcing portion 121*c* so, a change of thickness in correspondence with a difference of position is reduced, a flow of resin at a time of forming becomes smooth, and it is possible to prevent the void or the like from being generated in the collar portion 121*b* or the reinforcing portion 121*c*. The inventors of the present application have confirmed this matter after trial and error through various tests.

Further, in accordance with the present embodiment, since the reinforcing portion 121*c* exist even when making the thickness of the collar portion 121*b* comparatively thin, it is possible to secure a sufficient mechanical strength.

Figure 4B:
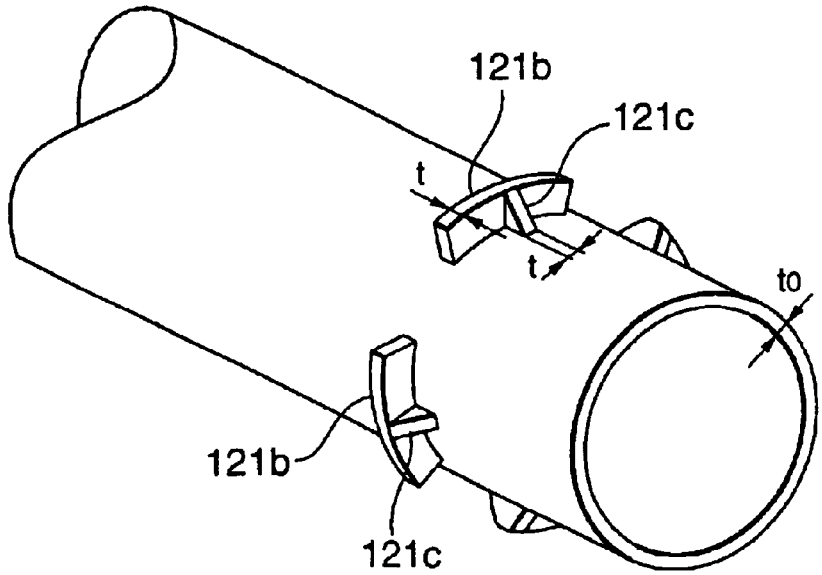
FIG. 4B is a partly perspective view of a modified embodiment of the embodiment in FIG. 4A.

FIG. 4B shows a structure in which a shape of a projection portion constituted by the collar portion 121*b* and the reinforcing portion 121*c* is formed in a substantially T shape. In this case, the thickness of the collar portion 121*b* and the reinforcing portion 121*c* is made equal to the thickness t0 of the cylinder portion 121*d* (that is, the ratio of thickness (t/t0)=1).

Accordingly, in this case, it is possible to restrain and prevent the generation of the void or the like in the projection portion and a periphery thereof in the same manner, and an electrical insulating property can be maintained. Further, with the help of existence of the reinforcing portion 121*c*, it is possible to secure a sufficient mechanical strength.

(Third Embodiment)

The present embodiment also corresponds to a countermeasure against the matter that the mechanical strength of the projection portion 121*b* is reduced for the reason of the turbulence of the resin flow generated at a time forming the primary spool 121, in the same manner as the first embodiment.

Figure 5:
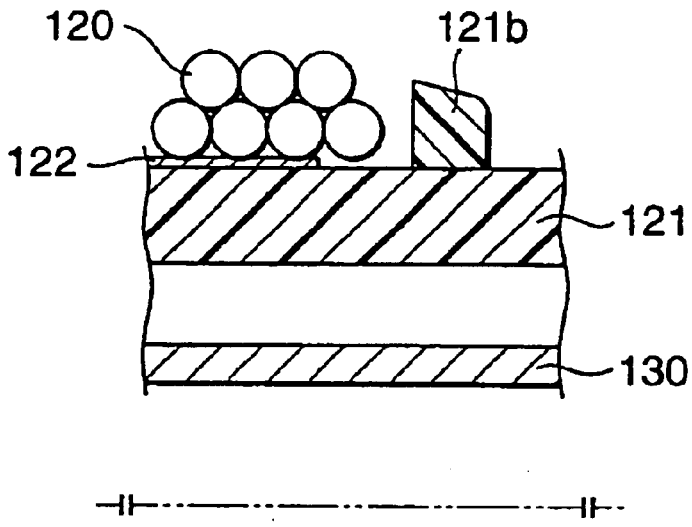
FIG. 5 is a cross sectional view showing a feature of an ignition coil in accordance with a third embodiment of the present invention.

That is, in accordance with the present embodiment, as shown in FIG. 5, a ring disc-like (flange-like) projection portion 121*b* is independently formed from the primary spool 121, and thereafter the independent projection portion 121*b* is assembled in the outer peripheral portion of the primary spool 121. In this case, it is desirable that the projection portion 121*b* is pressure inserted to the primary spool 121 at a degree of a transition fit so that the projection portion 121*b* does not easily move at a time of winding a projecting coil winding around the primary spool 121.

Next, a description will be given of a feature (an operation and effect) of the present embodiment.

The crack generated in correspondence to the thermal stress grows from a boundary portion between the thin film (the peeling tape) 122 and the resin layer formed by the cast resin wherein the thermal stress is easily concentrated, corresponding to a starting point so as to connect portions having a small mechanical strength, as shown in FIG. 5. In the present embodiment, since the projection portion 121*b* is formed independently from the primary spool 121, a shape of the primary spool 121 becomes a simple shape (a cylindrical shape in the present embodiment), so that the turbulence of the resin flow is hard to be generated at a time of forming the primary spool 121.

Accordingly, the crack generated from the boundary portion between the thin film (the peeling tape) 122 and the resin layer formed by the cast resin corresponding to the starting point does not make progress toward the primary spool 121 main body (the secondary coil 130), but makes progress along the interface (the adhesion surface) between the resin layer and the primary spool 121 and the interface (the adhesion surface) between the resin layer and the projection portion 121*b*.

By extension, since it is possible to prevent the crack from being generated in the primary spool 121, it is possible to stably secure the electrical insulation between the primary coil 120 and the secondary coil 130, and it is possible to improve a durability of the ignition coil 100.

(Fourth Embodiment)

Figure 6:
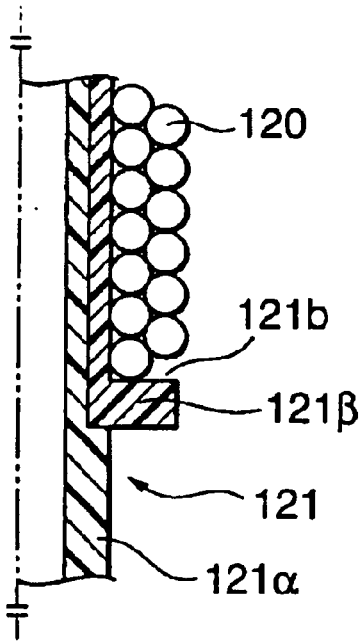
FIG. 6 is a cross sectional view showing a feature of an ignition coil in accordance with a fourth embodiment of the present invention.

The present embodiment is structured such that the thin film (the peeling tape) 122 is omitted, at least a portion corresponding to the coil 120 in the primary spool 121 is formed in a double cylinder structure having an inner tube portion 121α and an outer tube portion 121β, a projection portion 121*b* protruding to an outer side in a diametrical direction is integrally formed in an end portion in an axial direction of the outer tube 121β, and an adhesive strength between the resin material (the cast resin) and the outer tube portion 121β becomes smaller than an adhesive strength between the resin material (the cast resin) and the inner tube portion 121α, as shown in FIG. 6.

In this case, in the present embodiment, the outer tube portion 121β is made of a polypropylene (PP), and the inner tube portion 121α is made of a polyphenylene ether (PPE).

Next, a description will be given of a feature (an operation and effect) of the present embodiment.

Since the structure is made such that the adhesive strength between the resin material (the cast resin) and the outer tube portion 121β becomes smaller than the adhesive strength between the resin material (the cast resin) and the inner tube portion 121α, the outer tube portion 121β serves as a functioning part for achieving the same function as that of the thin film 122 in the embodiment mentioned above.

Accordingly, in the same manner as the thin film 122, the crack is generated from the boundary portion between the resin material (the cast resin) and the outer tube portion 121β corresponding to the starting point. On the contrary, the generated crack grows in such a manner as to connect the portions having the small mechanical strength as mentioned above, however, in the portion in which the projection portion 121*b* is formed, since the mechanical strength is easily reduced due to the void or the weld generated at a time of forming, as mentioned above, the crack generated from the boundary portion corresponding to the starting point makes progress to the inner tube portion 121α side having the simple shape with a low possibility.

Further, in the embodiment mentioned above, since the thin film 122 is not arranged all the area of the portion around which the coil winding of the primary coil 120 is wound (refer to FIG. 5), the crack generated from the boundary portion between the thin film (the peeling tape) 122 and the resin layer corresponding to the starting point easily makes progress to the secondary coil 130 side via the root portion side of the projection portion 121*b*. However, in accordance with the present embodiment, since all of the coil winding of the primary coil 120 are wound on the outer tube portion 121β serving the same function as that of the thin film 122, the starting point of the crack is hard to be generated in the portion around which the coil winding of the primary coil 120 is wound.

Accordingly, it is possible to prevent the crack from being generated and making progress in the portion close to the primary coil 120 (the portion between the primary coil 120 and the secondary coil 130 immediately below the primary coil 120). Further, it is possible to stably secure the electrical insulation between the primary coil 120 and the secondary coil 130, and it is possible to improve a durability of the ignition coil 100.

(Fifth Embodiment)

Figure 7A:
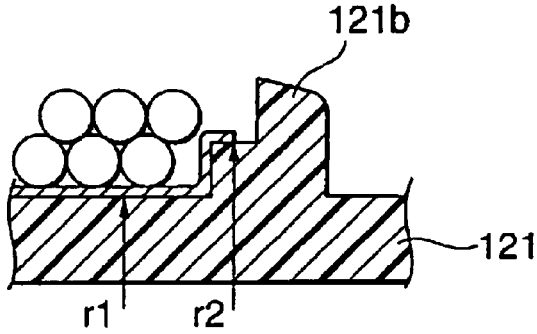
FIGS. 7A and 7B are cross sectional views showing a feature of an ignition coil in accordance with a fifth embodiment of the present invention, and respectively show two embodiments in which a shape of the feature portion is changed.
Figure 7B:
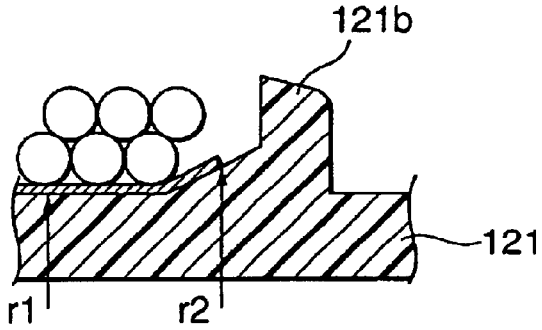

The present embodiment is structured, as shown in FIG. 7, such that a distance r2 from the thin film 122 in the end portion side in the axial direction of the primary spool 121 to the center axis of the primary spool 121 is set to be larger than a distance r1 from the thin film 122 in the substantially center portion in the axial direction of the primary spool 121 to the center axis of the primary spool 121.

Next, a description will be given of a feature (an operation and effect) of the present embodiment.

The crack is generated from the boundary portion between the thin film 122 and the resin layer corresponding to the starting point and makes progress (grows), in the manner mentioned above, however, in accordance with the present embodiment, since the distance r2 from the thin film 122 in the end portion side in the axial direction of the primary spool 121 corresponding to the starting point for generating the crack to the center axis of the primary spool 121 is set to be larger than the distance r1 from the thin film 122 in the substantially center portion in the axial direction of the primary spool 121 to the center axis of the primary spool 121, the way (the time) required until the crack gets to the center portion (the primary coil 130) is increased.

Accordingly, it is possible to prevent the electrical insulation (the primary spool 121) between the primary coil 120 and the second coil 130 from being early broken.

(Sixth Embodiment)

Figure 8:
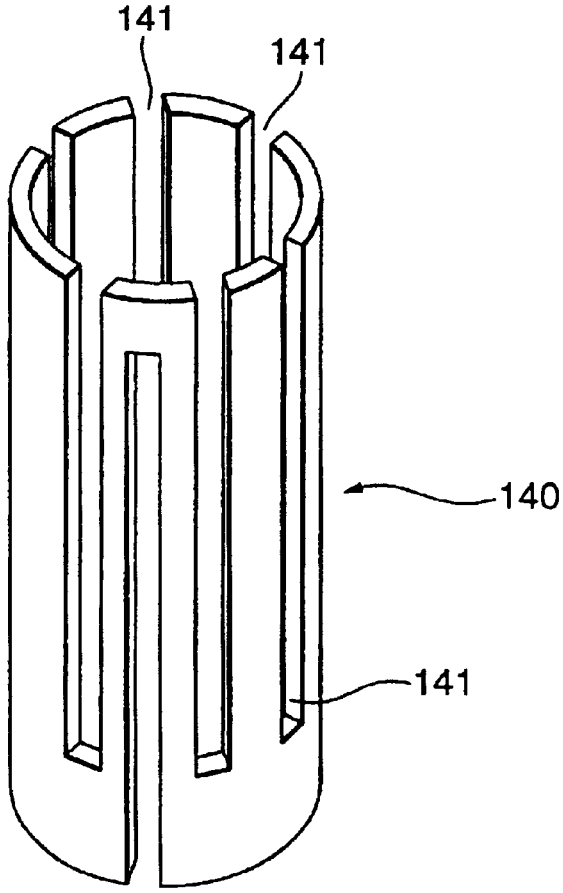
FIG. 8 is a perspective view showing a feature of an ignition coil in accordance with a sixth embodiment of the present invention.

The present embodiment is structured, as shown in FIG. 8, such that a plurality of slits 141 which are formed by separating a part of the outer peripheral core 140 so as to extend in a longitudinal direction are provided in the outer peripheral core 140.

Accordingly, since a rigidity of the outer peripheral core 140 is reduced in comparison with a simple cylindrical shape, the outer peripheral core 140 is deformed at a time when the thermal stress is applied, whereby it is possible to absorb the thermal stress. Therefore, it is possible to prevent the crack from being generated in the root portion or the like in the projection portion 121*b* of the primary spool 121.

(Seventh Embodiment)

Figure 9:
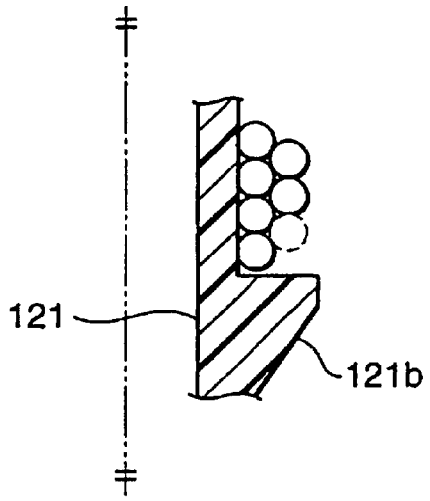
FIG. 9 is a cross sectional view showing a feature of an ignition coil in accordance with a seventh embodiment of the present invention.

The present embodiment is structured, as shown in FIG. 9, such that a predetermined gap is provided between the coil winding and the projection portion 121*b* so that a force (a moment) is not applied to the projection portion 121*b* due to the tension force applied to the coil winding at a time of winding the coil winding of the primary coil 120.

In this case, since the moment with respect to the root side of the projection portion 121*b* is increased in accordance that the number of steps (the number of layers) of the coil winding is in the upper steps, it is desirable that the gap between the coil winding and the projection portion 121*b* is provided at least after the second step (the second layer).

(Eighth Embodiment)

Figure 10:
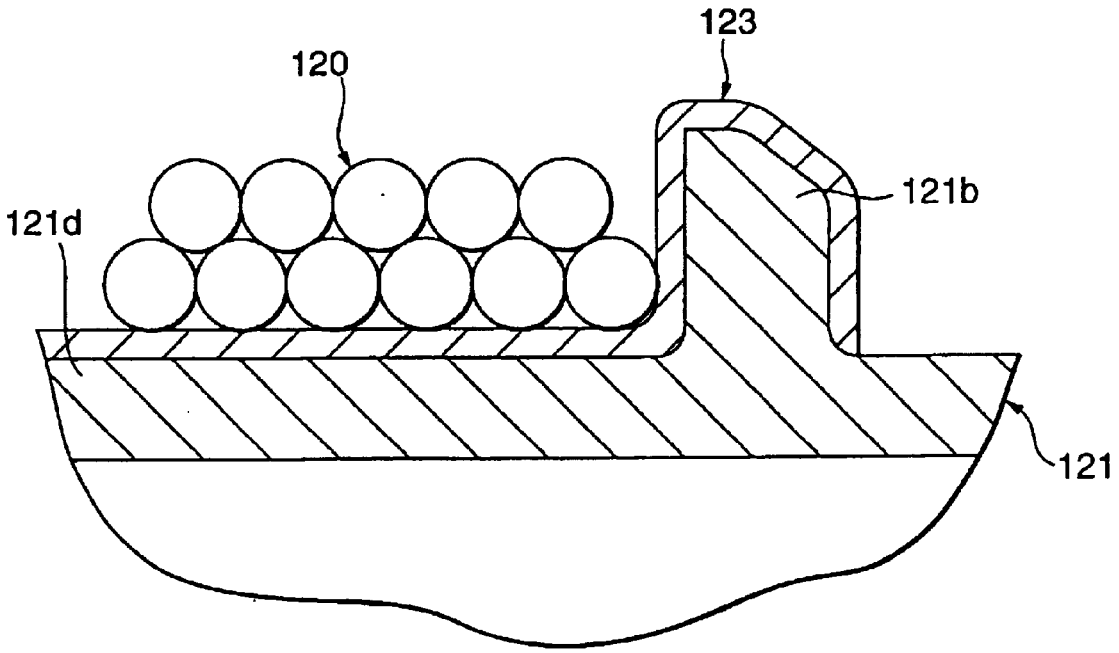
FIG. 10 is a cross sectional view showing a feature of an ignition coil in accordance with an eighth embodiment of the present invention.

The present embodiment is structured, as shown in FIG. 10, such that a rubber-like elastic film 123 is sprayed and coated on the outer surface of the primary spool 121 in which the cylinder portion 121*d* and the collar portion 121*b* are integrally formed. The elastic film 123 constitutes a cushion member, the thermal stress applied to the portion between the coil winding of the primary coil 120 and the primary spool 121, and the like is reduced, and it is possible to prevent the crack from being generated in the primary spool 121.

(Ninth Embodiment)

Figure 11:
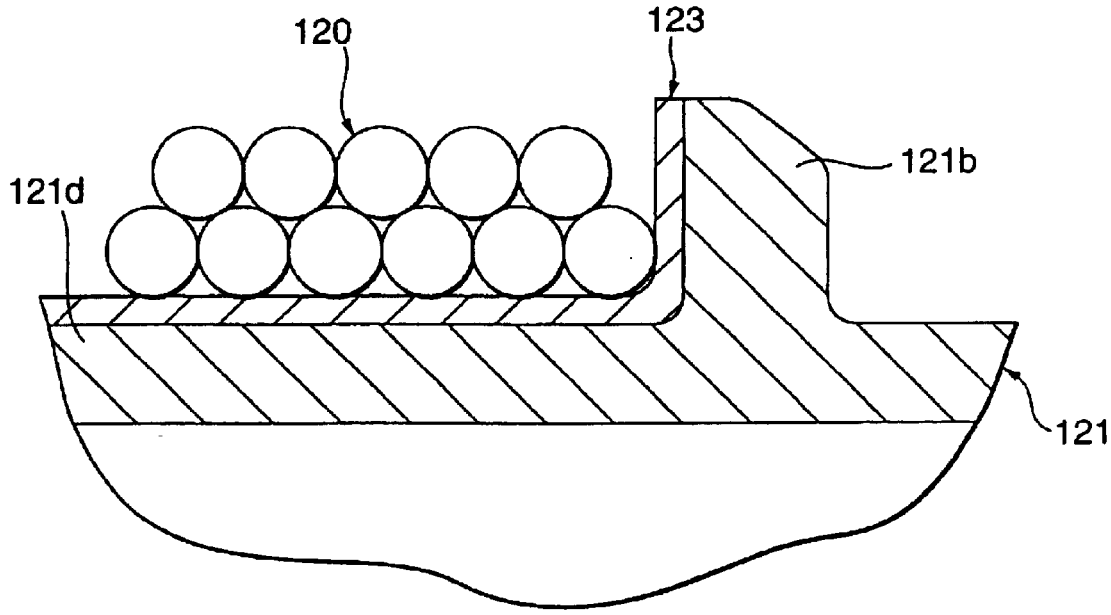
FIG. 11 is a cross sectional view showing a feature of an ignition coil in accordance with a ninth embodiment of the present invention.

The present embodiment is structured, as shown in FIG. 11, such that the rubber-like elastic film 123 is integrally formed on the outer surface of the primary spool 121 in which the cylinder portion 121*d* and the collar portion 121*b* are integrally formed. The elastic film 123 constitutes a cushion member, the thermal stress applied to the portion between the coil winding of the primary coil 120 and the primary spool 121, and the like is reduced, and it is possible to prevent the crack from being generated in the primary spool 121.

In this case, in the eighth embodiment mentioned above, a whole of the collar portion 121*b* is coated, however, in the ninth embodiment, in order to make the formation easy, only an upper surface side of the collar portion 121*b* (the coil winding side of the primary coil 120) is coated. Further, both of these elastic films 123 can be substituted for the conventional peeling tape (the adhesion restraining film) 122. Accordingly, it is possible to reduce a step of winding the thin film which conventionally requires a lot of steps.

(Tenth Embodiment)

The present embodiment is structured, as shown in FIG. 12, such that an elastic sheet 123 is wound around the outer surface of the cylinder portion (121*d*) in the primary spool 121. The elastic sheet 123 constitutes a cushion member, the thermal stress applied to the portion between the coil winding of the primary coil 120 and the primary spool 121, and the like is reduced, and it is possible to prevent the crack from being generated in the primary spool 121.

Figure 12A:
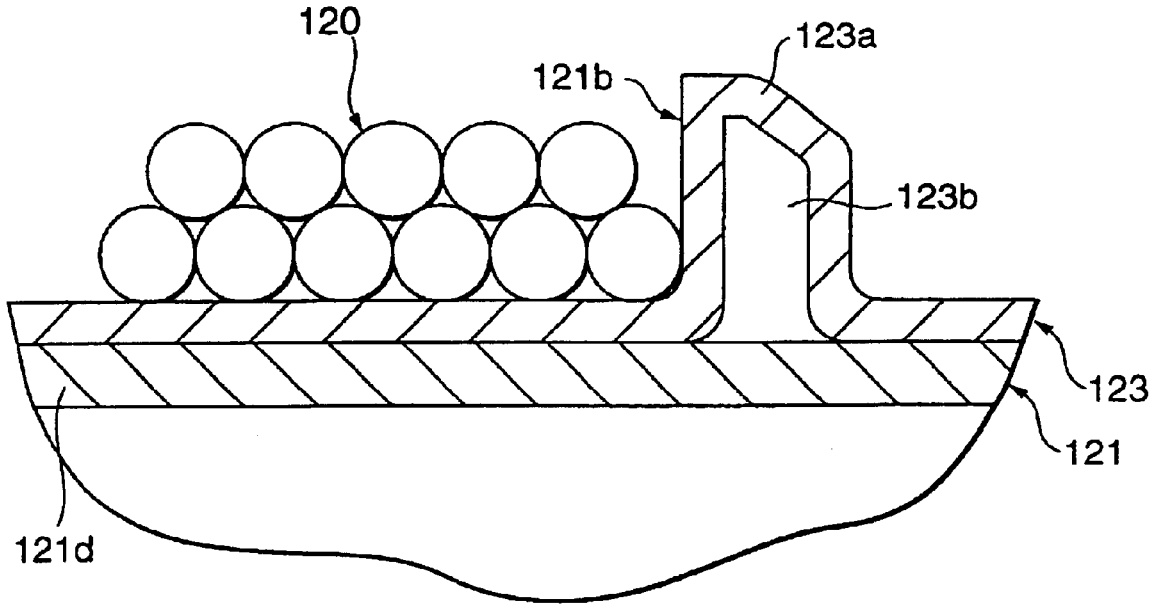
Figure 12B:
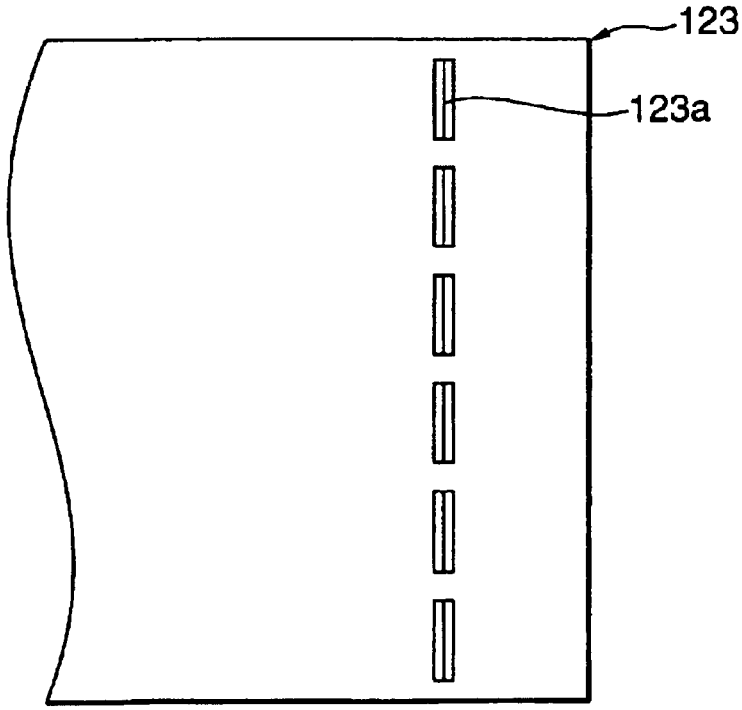

FIG. 12A is a cross sectional view showing a state in which the elastic sheet 123 is wound around the primary spool 121, and FIG. 12B is a plan view showing the elastic sheet 123 before being wound. As is apparent from both of the drawings, the elastic sheet 123 used in the present embodiment is obtained by press molding linear discontinuous projections 123*a* on a flat elastic sheet. When winding the elastic sheet 123 around the primary spool 121, the projections 123*a* form an annular collar portion 121*b*.

In this case, in the case of the present embodiment, an interior portion of the collar portion 121*b* forms a cavity 123*b*, however, the cavity 123*b* may be formed so as to be solid by using the elastic sheet 123 which is integrally formed by the rubber or the like. Further, in the present embodiment, the elastic sheet 123 corresponds to a substitute for the peeling tape 122.

(Eleventh Embodiment)

Figure 13:
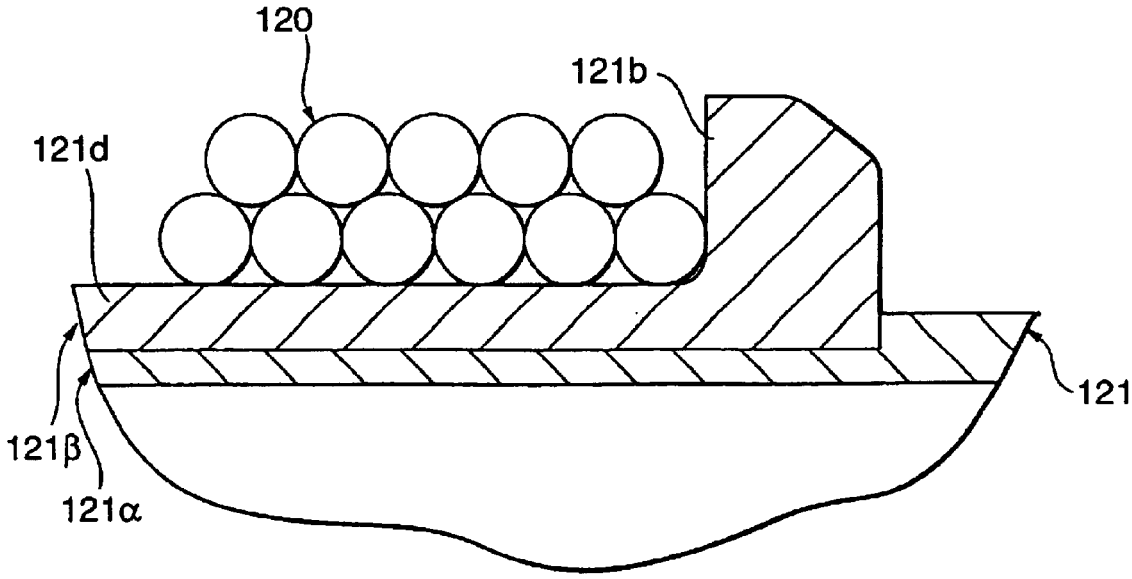
FIG. 13 is a cross sectional view showing a feature of an ignition coil in accordance with an eleventh embodiment of the present invention.

The present embodiment is structured, as shown in FIG. 13, such that the primary spool 121 is formed as a double cylinder structure constituted by the inner tube portion 121α and the outer tube portion 121β.

The inner tube portion 121α corresponds to a part of the integrally formed primary spool 121, and the outer tube portion 121β is pressure fitted to an outer peripheral surface side thereof.

The outer tube portion 121β has the cylinder portion 121*d* around which the coil winding of the primary coil 120 is wound, and the collar portion 121*b* protruding to an outer side in the diametrical direction from an end in an axial direction of the cylinder portion 121*d*, and is integrally formed by the elastic member such as the rubber or the like. Further, the outer tube portion 121β constitutes a cushion member, the thermal stress applied to the portion between the coil winding of the primary coil 120 and the primary spool 121, and the like is reduced, and it is possible to prevent the crack from being generated in the primary spool 121. In this case, in the present embodiment, the outer tube portion 121β corresponds to a substitute for the peeling tape 122.

(Twelfth Embodiment)

Figure 15:
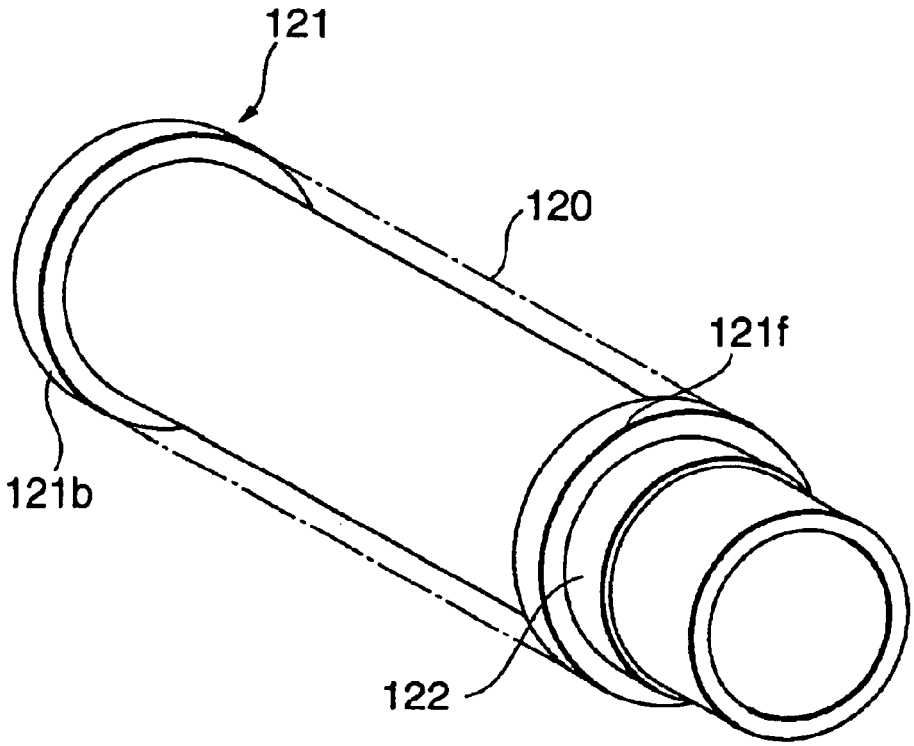
FIG. 15 is a perspective view of a primary spool of an ignition coil in accordance with a twelfth embodiment of the present invention.
Figure 16:
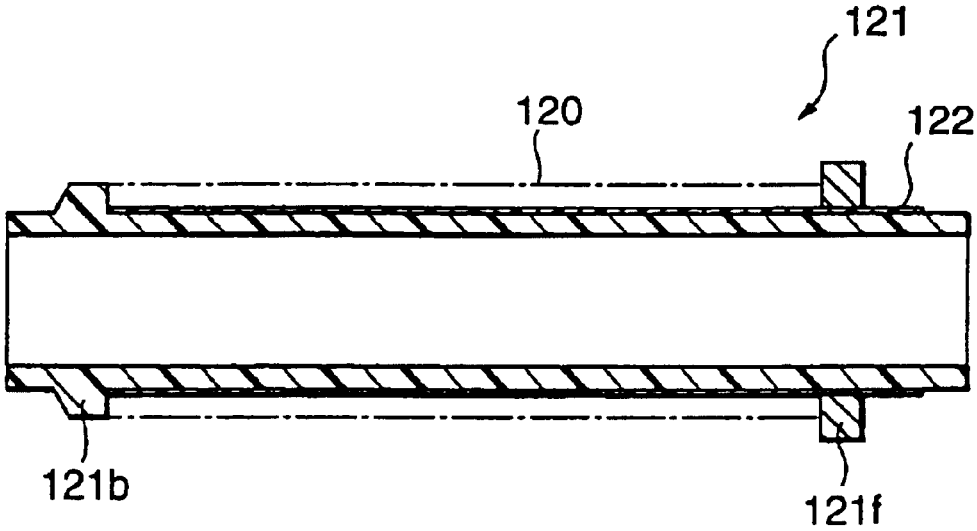
FIG. 16 is a cross sectional view of the primary spool of the ignition coil in accordance with the twelfth embodiment of the present invention.

The present embodiment is structured such that a post-provided collar portion is arranged from an outer periphery side of the peeling tape in the primary spool. FIG. 15 shows a perspective view of the primary spool in accordance with the present embodiment. Further, FIG. 16 shows a cross sectional view in the axial direction of the primary spool in the present embodiment.

A projection portion 121*b* is integrally formed in one end portion in the axial direction of the outer peripheral surface in the primary spool 121, that is, in an end portion in a high voltage terminal side. The projection portion 121*b* is formed in a flange shape. A peeling tape 122 (an adhesion restraining film) made of the PET is annularly provided in a center side in the axial direction of the projection portion 121*b* on the outer peripheral surface of the primary spool 121. The peeling tape 122 extends to another end portion in the axial direction of the primary spool 121, that is, an end portion in the connector portion side. The coil 120 is wound around the outer peripheral surface of the peeling tape 122 in a state in which the end in the high voltage terminal side is held in the projection portion 121*b*. The post-provided collar portion 121*f* is made of a resin such as an SPS, a PPE or the like, and is formed in an O shape. The post-provided collar portion 121*f* is arranged on the outer peripheral surface of the peeling tape, in the end portion in the connector portion side of the primary spool 121. In other words, the peeling tape 122 extends to the end side in the connector portion side rather than the post-provided collar portion 121*f*.

The assembly is executed by at first forming the primary spool 121 in which the projection portion 121*b* is arranged, next annularly providing the peeling tape 122 on the outer peripheral surface of the primary spool 121, then winding the coil 120 around the middle portion in the axial direction on the outer peripheral surface of the peeling tape 122 and finally annularly providing the post-provided collar portion 121*f* in the axial direction from the end in the connector portion side on the outer peripheral surface of the peeling tape 122.

In accordance with the present embodiment, the peeling tape 122 extends to the end side in the connector portion side rather than the post-provided collar portion 121*f*. Accordingly, even in the end portion in the connector portion side of the primary spool 121, the thermal stress can be shut off.

(Thirteenth Embodiment)

A difference between the present embodiment and the twelfth embodiment exists in a point that the post-provided collar portion is formed in a C shape. Further, it also exists in a point that the peeling tape extends to an end edge in the connector portion side of the primary spool. Accordingly, a description will be given of only the differences.

Figure 17:
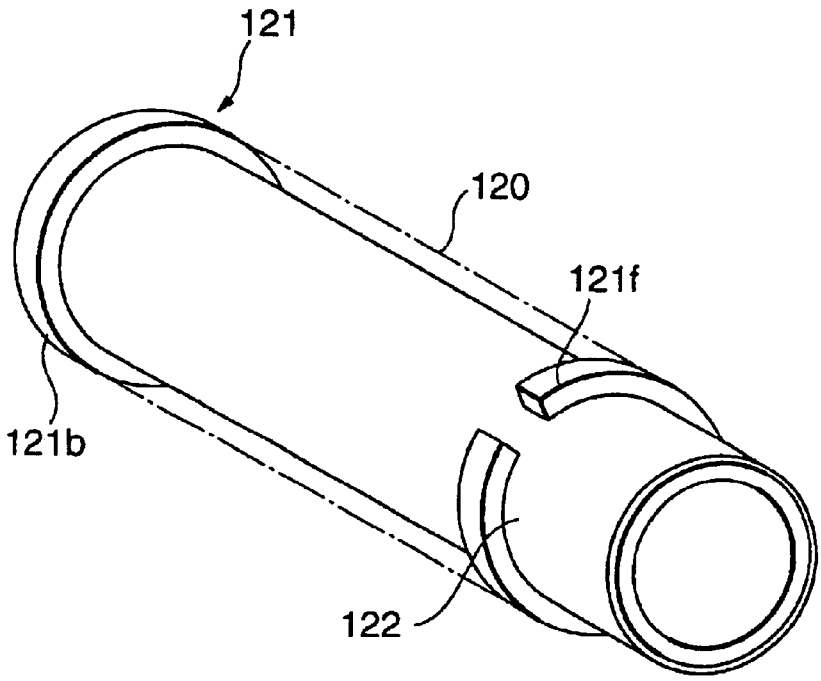
FIG. 17 is a perspective view of a primary spool of an ignition coil in accordance with a thirteenth embodiment of the present invention.

FIG. 17 shows a perspective view of the primary spool in accordance with the present embodiment. As shown in the drawing, the post-provided collar portion 121*f* is formed in the C shape. Further, the peeling tape 122 extends to the end edge in the connector portion side of the primary spool 121. At a time of assembling, the post-provided collar portion 121*f* is flexibly deformed from the diametrical direction not from the axial direction so as to be pressure inserted and annularly provided to the outer peripheral surface of the peeling tape 122.

In accordance with the present embodiment, the peeling tape 122 extends to the end edge in the connector portion side of the primary spool 121. Accordingly, it is possible to shut off the thermal stress in a wider range.

(Fourteenth Embodiment)

A difference between the present embodiment and the twelfth embodiment exists in a point in which the post-provided collar portion is not arranged. Further, it also exists in a point in which the coil annularly provided in the primary spool is a shape keeping coil constituted by a self welding coil winding. Accordingly, a description will be given of only the differences.

Figure 18:
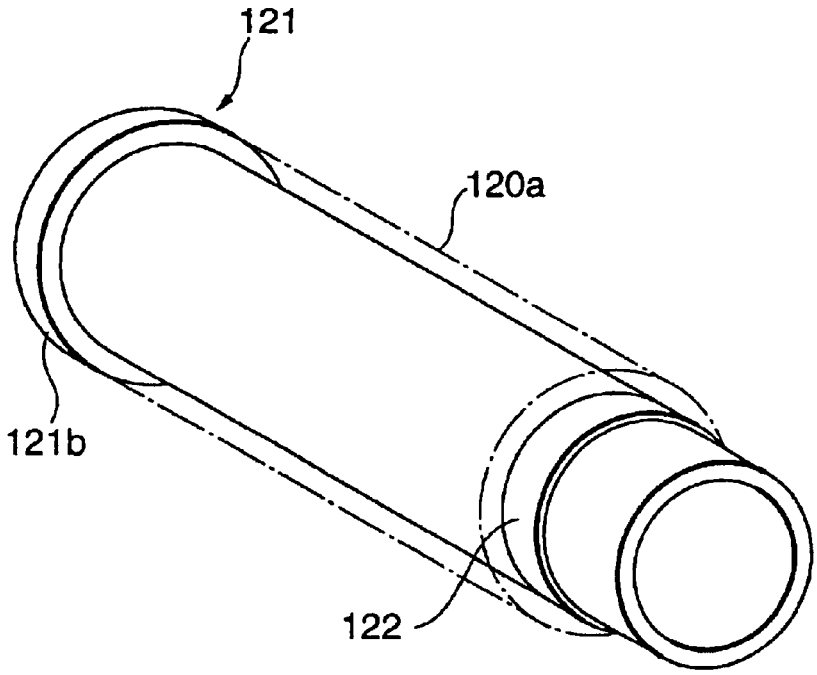
FIG. 18 is a perspective view of a primary spool of an ignition coil in accordance with a fourteenth embodiment of the present invention.

FIG. 18 shows a perspective view of the primary spool in accordance with the present embodiment. A shape keeping coil 120*a* is wound around the outer peripheral surface of the peeling tape 122 in a state in which the high voltage terminal side end is held in the projection portion 121*b*. The shape keeping coil 120*a* is formed by the self welding coil winding. The self welding coil winding is formed by double coating a conductor such as a Cu or the like with an insulative layer and a fusion layer. In particular, the shape keeping coil is manufactured by at first winding the self welding coil winding around a columnar mold and next applying an electric current to the self welding coil winding so as to fusion bonding the fusion layers with each other due to a Joule heat.

The shape keeping coil 120*a* can keep a cylindrical shape by itself. Therefore, in accordance with the present embodiment, the collar portion for holding the coil winding is not required. Accordingly, it is possible to extend the peeling tape 122 to the end portion in the connector portion side of the primary spool 121 without being disturbed by the collar portion. Therefore, even in the end portion in the connector portion side of the primary spool 121, the thermal stress can be shut off.

(Other Embodiments)

In the embodiments mentioned above, the description is mainly given of the primary spool, however, it is possible to consider that the same matter is applied to the secondary spool. Further, the inner peripheral side is set to the secondary coil and the outer peripheral side is set to the primary coil, however, the present invention is not limited to this, and the structure may be made such that the outer peripheral side is set to the secondary coil and the inner peripheral side is set to the primary coil.

Further, the present invention is not limited to the structures shown in the embodiments mentioned above, and at least two of the embodiments mentioned above may be combined.

What is claimed is:

1. An ignition coil for an internal combustion engine comprising:

an integrally formed resin spool and a coil constituted by a coil winding wound around said spool; and a high electric voltage being supplied to an ignition apparatus in the internal combustion engine, wherein said spool is provided with a cylinder portion around which said coil is wound, a collar portion protruding to an outer side in a diametrical direction from an end side outer peripheral surface of said outer portion so as to form a circumferential shape, and a reinforcing portion connected to said collar portion, extending in an axial direction of said cylinder portion and reinforcing said collar portion, and wherein a ratio of thickness (t/t0) of a thickness (t) of said collar portion and/or the reinforcing portion with respect to a thickness (t0) of said cylinder portion is equal to or less than 1.5.

2. The ignition coil for an internal combustion engine as claimed in claim 1, wherein said ratio of thickness (t/t0) is equal to or less than 0.1.

3. The ignition coil for an internal combustion engine as claimed in claim 1, wherein said reinforcing portion is extended from a substantially center of said collar portion and form a substantially T shape with said collar portion.

4. The ignition coil for an internal combustion engine as claimed in claim 1, wherein said reinforcing portion is extended from both end sides of said collar portion and form a substantially U shape with said collar portion.

* * * * *